United States Patent [19]

Navi

[11] 4,158,333

[45] Jun. 19, 1979

[54] INKING BAFFLE FOR ROTARY NEWSPAPER PRESSES

[75] Inventor: Menashe Navi, Lebanon, N.J.

[73] Assignee: ANPA Research Institute, Easton, Pa.

[21] Appl. No.: 901,652

[22] Filed: May 1, 1978

[51] Int. Cl.[2] ..... B41F 31/06; B41L 27/08

[52] U.S. Cl. ..... 101/363; 101/364; 101/169

[58] Field of Search ..... 101/363, 350, 364, 207, 101/208, 210, 148, 147, 157, 169; 261/92, 91; 239/219, 220; 118/259

[56] References Cited

U.S. PATENT DOCUMENTS

| | | | |
|---|---|---|---|
| 1,497,196 | 6/1924 | Potdevin | 118/258 |
| 1,846,856 | 2/1932 | Franeis | 118/258 |
| 2,196,412 | 4/1940 | Grembecki | 261/92 X |
| 2,276,662 | 3/1942 | Matuschke | 101/363 |
| 3,009,417 | 11/1961 | Saul | 101/364 X |
| 3,366,091 | 1/1968 | Mull | 118/259 |
| 3,504,626 | 4/1970 | Worthington | 101/350 X |
| 3,585,932 | 6/1971 | Granger | 101/169 X |
| 3,589,287 | 6/1971 | Woessner | 101/363 |
| 3,712,031 | 1/1973 | Cruz | 261/92 X |
| 3,898,955 | 8/1975 | Rosette et al. | 118/259 X |

*Primary Examiner*—J. Reed Fisher

*Attorney, Agent, or Firm*—David H. Semmes; Warren E. Olsen

[57] ABSTRACT

A baffle for use in rotary newspaper printing press ink reservoirs. In such ink reservoirs the inking cylinder, while rotating at high speed contacts ink within the reservoir. Conventionally, the high speed rotation of the inking cylinder creates vibrations and turbulence in the ink, such that air is forced between the rotating surface of the inking cylinder and the printing ink, causing bubbles and non-uniform inking of the ink cylinder. The present system includes a series of baffles positioned within the ink reservoir so as to inhibit turbulence and enhance the flow of ink onto the surface of the rotating cylinder.

8 Claims, 7 Drawing Figures

INKING BAFFLE FOR ROTARY NEWSPAPER PRESSES

CROSS-REFERENCES TO RELATED APPLICATIONS

An improvement upon applicant's earlier filed INKING SYSTEM FOR ROTARY NEWSPAPER PRINTING PRESSES (Ser. No. 843,616), filed Oct. 19, 1977 now abandoned.

BACKGROUND OF THE INVENTION (1) Field of the Invention

Rotary newspaper printing presses of the type wherein an engraved surface roller is immersed within the ink reservoir prior to its contact with a plate cylinder or rubber form friction dry rollers as in the case of offset systems. Particularly, baffle systems for improving the flow of ink from the reservoir onto the surface of the rotating inking cylinder.

(2) Description of the Prior Art

Being submitted separately under the provisions of 37 C.F.R. 1.97.

SUMMARY OF THE INVENTION

According to the present invention, a baffle is supported in the ink reservoir, such that a series of vertically disposed plates are presented in side-by-side array across the reservoir and adjacent the point of contact between the printing ink and the rotating cylinder surface. A unitary front ink flow guide interconnects the plates adjacent the rotating cylinder, so as to define at the top of the plates an ink into contact aperture and at the bottom of the plates an ink outflow aperture. A rear ink flow guide may be provided for interconnecting the plates and defining a further guide for ink flow in a circular pattern within the ink reservoir. A top plate may be superposed with the ink surface, so as to inhibit turbulent wave-like action of the ink adjacent the rotating cylinder surface.

As a result, turbulence of the ink, due both to vibrations and friction during high speed rotation of the inking cylinder, is inhibited and the entrainment of air, as bubbles, within the flowing ink is substantially eliminated. As a result, enhanced deposition of ink in the rotating cylinder surface is provided. The baffle has particular application to an inking cylinders of the type having an engraved surface defining ink repository cells.

DESCRIPTION OF THE PREFERRED EMBODIMENTS

Figure 1:
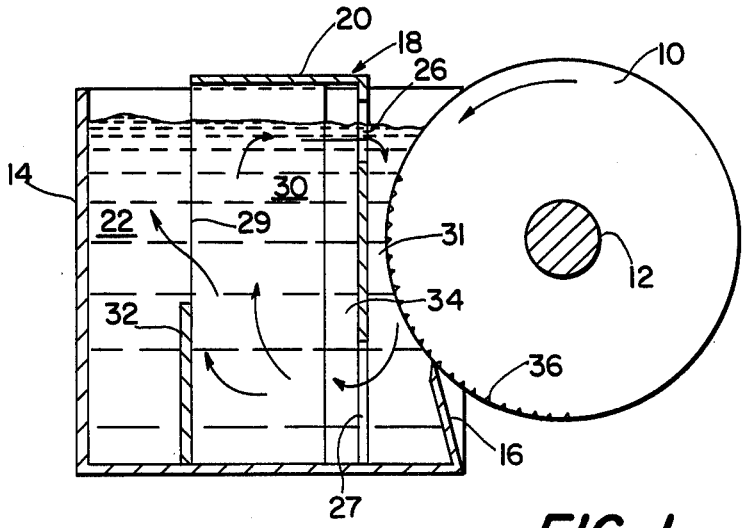
FIG. 1 is a schematic view of a proposed baffle system for use in connection with an ink reservoir wherein the front wall of the reservoir is defined by a reverse angle doctor blade contacting the surface of the rotating inking cylinder.
Figure 2:
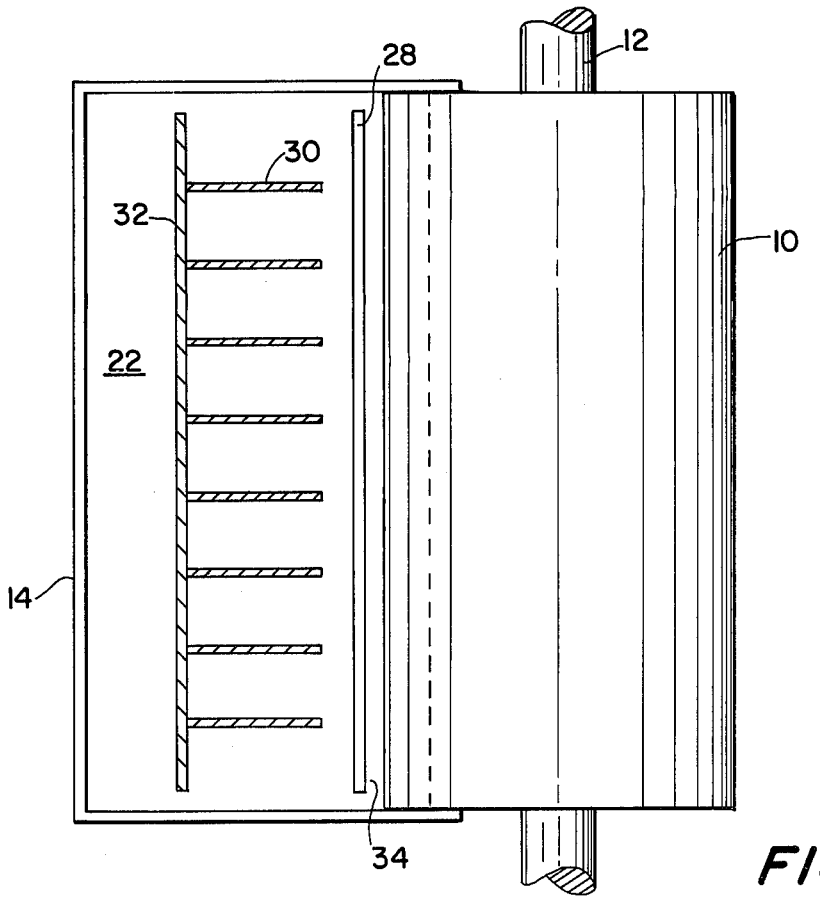
FIG. 2 is a top plan with the cover of the baffle removed, so as to show the side-by-side disposition of the vertical plates in parallel with the axis of the rotating cylinder and offset with respect to the front ink flow guide.
Figure 4:
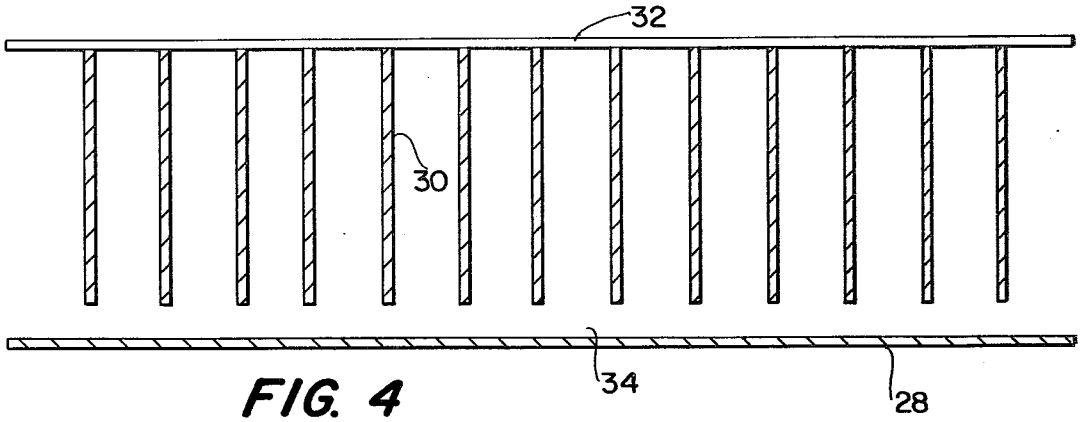
FIG. 4 is a top plan of a removable baffle unit with the top plate removed and showing side-by-side array of the vertical plates intermediate the front ink flow guide and the rear ink flow guide.
Figure 7:
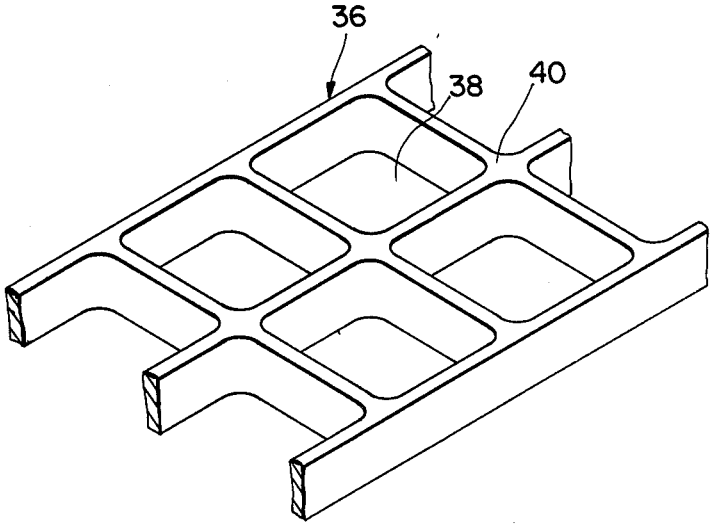
FIG. 7 is a fragmentary, enlarged perspective, showing the engraved ink repository cells in the surface of the inking cylinder.

In FIG. 1 a conventional inking cylinder or ink roller 10 of the tupe having a surface with engraved ink repository cells is shown mounted upon transverse shaft 12, so as to be contactable with printing ink 22 within ink reservoir 14. A reverse angle doctor blade 16 defines the front wall of reservoir 14 and is contactable with the engraved surface of inking cylinder 10, so as to ensure removal of all ink from the cylinder except for that which is reposed within the individual ink cells. Such repository cells 38, as illustrated in FIG. 7, may be of rectangular configuration approximately 250 cells per linear inch, each having a depth of 10 microns. The inking cylinder may be rotated at speeds such that 700–2000 lineal feet of moving web per foot are printed.

FIG. 7 illustrates a "quad" type cell configuration; however, other configurations may be employed. The ink type is conventional hydrocarbon base letter press, newspaper press, viscosity 2000–2500 centipoises. The only practical limitation on the speed of rotation of cylinder 10 is that all repository cells 38 upon contact with ink 22 shall be filled.

Figure 6:
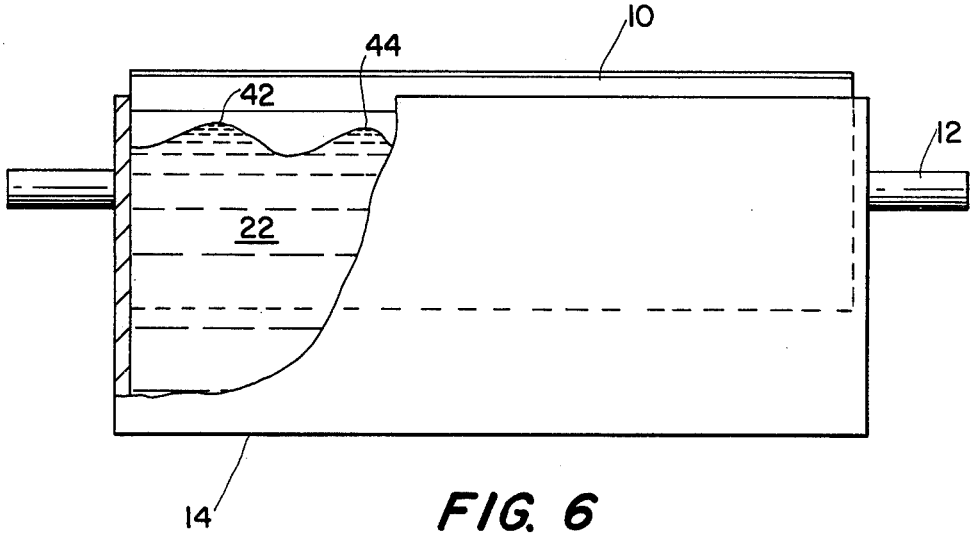
FIG. 6 is a rear elevation of the reservoir, showing the turbulent wave action of the ink as it contacts the surface of the inking cylinder in high speed rotation.

Conventionally, high speed rotation of inking cylinder 10 and the friction generated in its contact with printing ink 22 generates both a vibration and turbulence in the ink as it contacts the surface of the rotating inking cylinder. This effect is illustrated in FIG. 6 where ink 22 is shown as having a turbulent or wave-like profile 42, 44 adjacent the point of contact between ink 22 the surface of the rotating cylinder 10. Such turbulence results in the entrainment of air within ink 22 both as a layer of air between ink and cylinder and as bubbles and thereby impedes or inhibits deposition of ink within the engraved repository cells 38. As a result, doctor blade 16 in wiping off ink creates dry spots where ink has not been reposed within the individual cells 38.

In order to eliminate such turbulence in printing ink 22, a baffle 18 is proposed and may consist of a series of vertically disposed plates 30 maintained in side-by-side array by means of front ink flow guide 24, defining a top ink into contact aperture 26 and a bottom ink outflow aperture 27. A median portion of the baffle 28 extends across the front of the vertical plates 30, so as to define an aperture 34 intermediate front ink flow guide 24 and the individul plates 30. Baffle 18 may include a unitary top 20, extending across the tops of the plates 30. Also, rear inkflow guide 32 may interconnect plates 30, so as to define a further ink flow aperture 29. As will be apparent, rotation of the roller 10 thus generates a generally circular flow of ink within the ink reservoir and in parallel with the cylinder 10 rotation, as indicated in FIG. 1.

Figure 5:
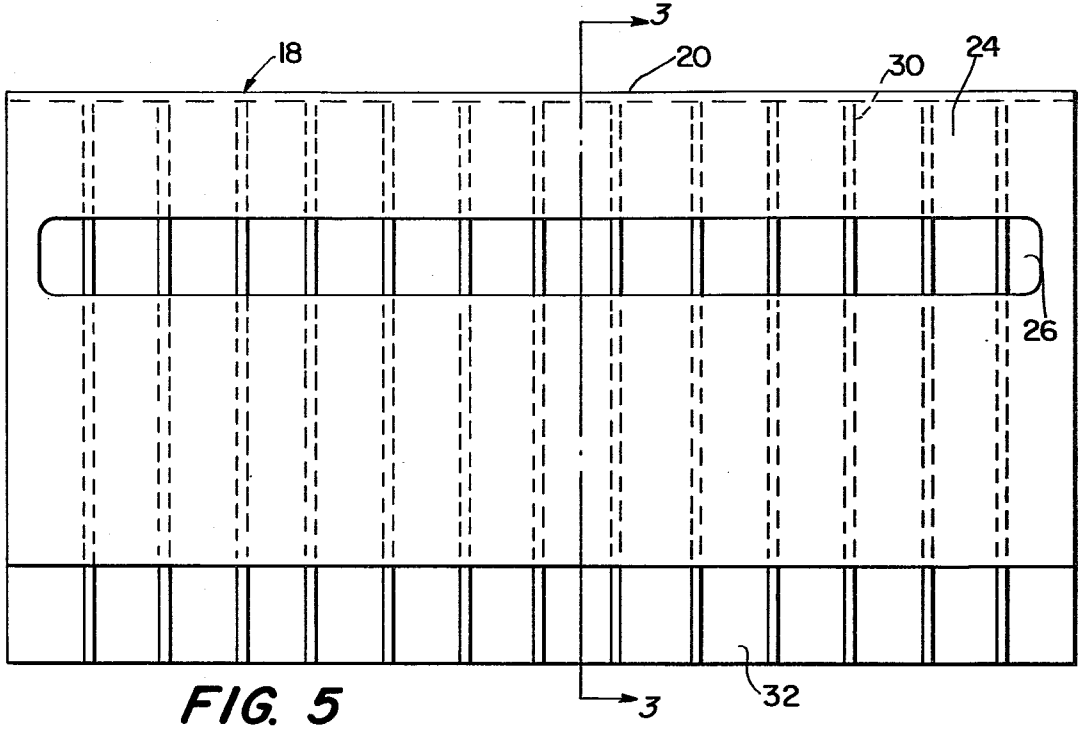
FIG. 5 is a front elevation of the baffle unit, showing the front ink flow guide showing an ink into contact aperture at the top and an ink outflow aperture at the bottom.
Figure 3:
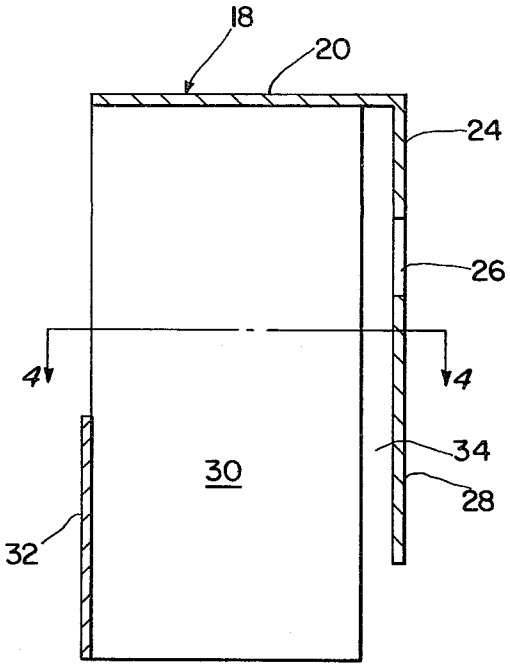
FIG. 3 is a vertical section of the baffle, showing the vertically disposed baffle plates as well as the front ink flow guide and rear ink flow guide interconnecting the plates.

In FIG. 5 there is illustrated the top ink into contact aperture 26, defined adjacent the point of initial contact between roller 10 surface and ink 22 and a bottom ink outflow aperture 27, defined adjacent the point of disengagement of the roller 10 surface with printing ink 22. As will be apparent, baffle 18 provides for enhanced ink circulation within the reservoir and enhanced contact of ink with the individual engraved repository cells 28. As a result, there is substantial elimination of the dry spots which are manifest in high speed rotation of conventional letter press or offset printing systems.

Operating parameters may include:

(1) Speed of engraved inking cylinder: up to 2000 ft./min.

(2)

(a) Cell dimensions: cell total width 100 micron (90 micron open space and 10 micron wall thickness)

(b) Cell depth—10 microns 250 cells per linear inch (62.500 cells per sq. inch)

(3) Cell configuration: quad type cell (4) Ink type used:

(a) Hydrocarbon base ink normally used for letterpress newspaper press-viscosity range 2000–2500 centipoises.

(b) Hydrocarbon base ink normally used for offset newspaper press—viscosity 3500–4000 centipoises.

(c) Water base ink with viscosity of 2000–3000 centipoises.

(5) Density level achieved with the above inks and cell structure—0.90 to 1.05.

As illustrated in FIG. 1, ink is drawn through ink into contact aperture 26, the distance "A" between baffle 24 and the engraved roller 10 surface being larger at entry. The distance between baffle 24 and the surface of the cylinder 10 becomes narrower at mid-point 31, creating higher pressure which helps to eliminate air turbulence and assists in filling the engraved repository cells 38 within the surface of roller 10. Ink 22 thus moves at high velocity due to contact with rotating cylinder 10 and exits through ink outflow aperture 27. Back ink flow guide 32 diverts the ink flow for continual circulation and, of course, restrains agitation. The individual separators or vertically disposed plates minimize, of course, excessive agitation across the width of a press and across the width of the entire reservoir 14.

Manifestly, various types of baffle structures may be employed without departing from the spirit and scope of the invention.

I claim:

1. In a printing system of the type embodying a rotatable inking cylinder contactable with printing ink within an ink reservoir, the improvement comprising:

A. A baffle supported in said reservoir adjacent said inking cylinder, said baffle further including:

i. a series of vertically disposed plates mounted in side-by-side array perpendicularly to the axis of said inking cylinder;

ii. a unitary front ink flow guide interconnecting said plates along the axis of said inking cylinder, so as to define an ink into contact aperture in the upper portion of said ink flow guide and an ink outflow aperture in the lower portion of said ink flow guide, a median portion of said ink flow guide intermediate said ink into contact and outflow apertures defining a transverse baffle across said reservoir and in parallel with the axis of said inking cylinder, and iii. a unitary back ink flow guide interconnecting the bottom rear of said vertically disposed plates, so as to define an ink outflow guide across the bottom of said reservoir.

2. A baffle as in claim 1, said front ink flow guide and said rear ink flow guide defining a path for circular flow of ink within said reservoir in parallel with the rotation of said inking cylinder.

3. A baffle as in claim 2, in combination with a doctor blade supported in the lower front portion of said reservoir, as a front wall, and contactable with the surface of said rotating cylinder.

4. A baffle as in claim 3, in combination with a reverse angle doctor blade supported in the lower front portion of said reservoir, as a front wall, and contactable with the surface of said rotating cylinder.

5. A baffle as in claim 4, including a top plate interconnecting said vertically disposed plates above the path of contact between ink and inking cylinder within said ink reservoir.

6. A baffle as in claim 5, said top plate being superposed with respect to the surface of said ink within said reservoir.

7. A baffle as in claim 6, said vertically disposed plates being of greater height than said front ink flow guide, such that each plate is supported upon said reservoir bottom as a vertical partition in both said ink into contact aperture and said ink outflow aperture.

8. A baffle as in claim 7, said vertically disposed plates being of lesser width than said baffle, such that a transverse aperture is defined across the front of said reservoir and intermediate said plates and said front flow guide.

* * * * *